United States Patent [19]

Rogers, Jr. et al.

[11] 4,140,594

[45] Feb. 20, 1979

[54] MOLTEN SALT BATH CIRCULATION PATTERNS IN ELECTROLYSIS

[75] Inventors: Elmer H. Rogers, Jr., Palestine, Tex.; Stanley C. Jacobs, Lower Burrell, Pa.; Lester L. Knapp, Palestine, Tex.; William R. Allen, Maryville, Tenn.

[73] Assignee: Aluminum Company of America, Pittsburgh, Pa.

[21] Appl. No.: 797,778

[22] Filed: May 17, 1977

[51] Int. Cl.[2] ..... C25C 3/00; C25C 3/06

[52] U.S. Cl. ..... 204/67; 204/64 R; 204/243 R; 204/247

[58] Field of Search ..... 204/64 R, 67, 243 R, 204/247, 262

[56] References Cited

U.S. PATENT DOCUMENTS

| | | | |
|---|---|---|---|
| 1,569,606 | 1/1926 | Ashcroft | 204/244 |
| 2,194,443 | 3/1940 | Hardy et al. | 204/247 |
| 3,374,163 | 3/1968 | Meier et al. | 204/64 R |
| 3,554,893 | 1/1971 | DeVarda | 204/244 |
| 3,822,195 | 7/1974 | Dell et al. | 204/64 R |
| 3,909,375 | 9/1975 | Holliday | 204/67 |

*Primary Examiner*—Howard S. Williams
*Attorney, Agent, or Firm*—Daniel A. Sullivan, Jr.

[57] ABSTRACT

A method for producing metal by electrolysis in a molten salt bath containing superimposed electrodes, at least one of which is a bipolar electrode. The arrangement of the electrodes creates interelectrode spaces between them. Bath is swept through these interelectrode spaces. This method is improved by providing circulation of the bath from one interelectrode space to the next at a location inwards of the outer peripheries of the electrodes. This can be accomplished e.g. by boring holes through the electrodes. It can also be accomplished by breaking the electrodes into individual, mutually separated stacks of electrodes, the circulation of the improvement then occurring e.g. in the space between the stacks.

6 Claims, 2 Drawing Figures

MOLTEN SALT BATH CIRCULATION PATTERNS IN ELECTROLYSIS

BACKGROUND OF THE INVENTION

The present invention relates to methods of producing metal by electrolysis in a molten salt bath. More particularly, the present invention relates to methods for operating bipolar cells for carrying out such electrolysis.

U.S. Pat. No. 3,822,195 issued July 2, 1974 in the name of M. B. Dell et al. for "Metal Production" illustrates a method for producing metal by electrolysis of aluminum chloride in a molten salt containing superimposed electrodes. Bipolar electrodes are included. The bath circulates peripherally of the electrodes upwards on one side and downwards on another side.

U.S. Pat. No. 3,554,893 issued Jan. 12, 1971 in the name of G. DeVarda for "Electrolytic Furnaces Having Multiple Cells Formed of Horizontal Bipolar Carbon Electrodes" illustrates likewise a method for producing metal by electrolysis in a molten salt bath containing superimposed electrodes. This time the substance being electrolyzed is aluminum oxide. The electrodes are separated into two stacks. The type of bath circulation achieved is not discussed.

SUMMARY OF THE INVENTION

It is an object of the present invention to provide a new type of bath circulation in a method for producing metal by electrolysis in a molten salt bath containing superimposed electrodes, at least one of the electrodes being a bipolar electrode, bath being swept through interelectrode spaces between the electrodes.

This as well as other objects which will become apparent in the discussion that follows are achieved according to the present invention by circulating the bath between interelectrode spaces inwards of the outer peripheries of the electrodes.

DESCRIPTION OF THE PREFERRED EMBODIMENTS

Figure 1:
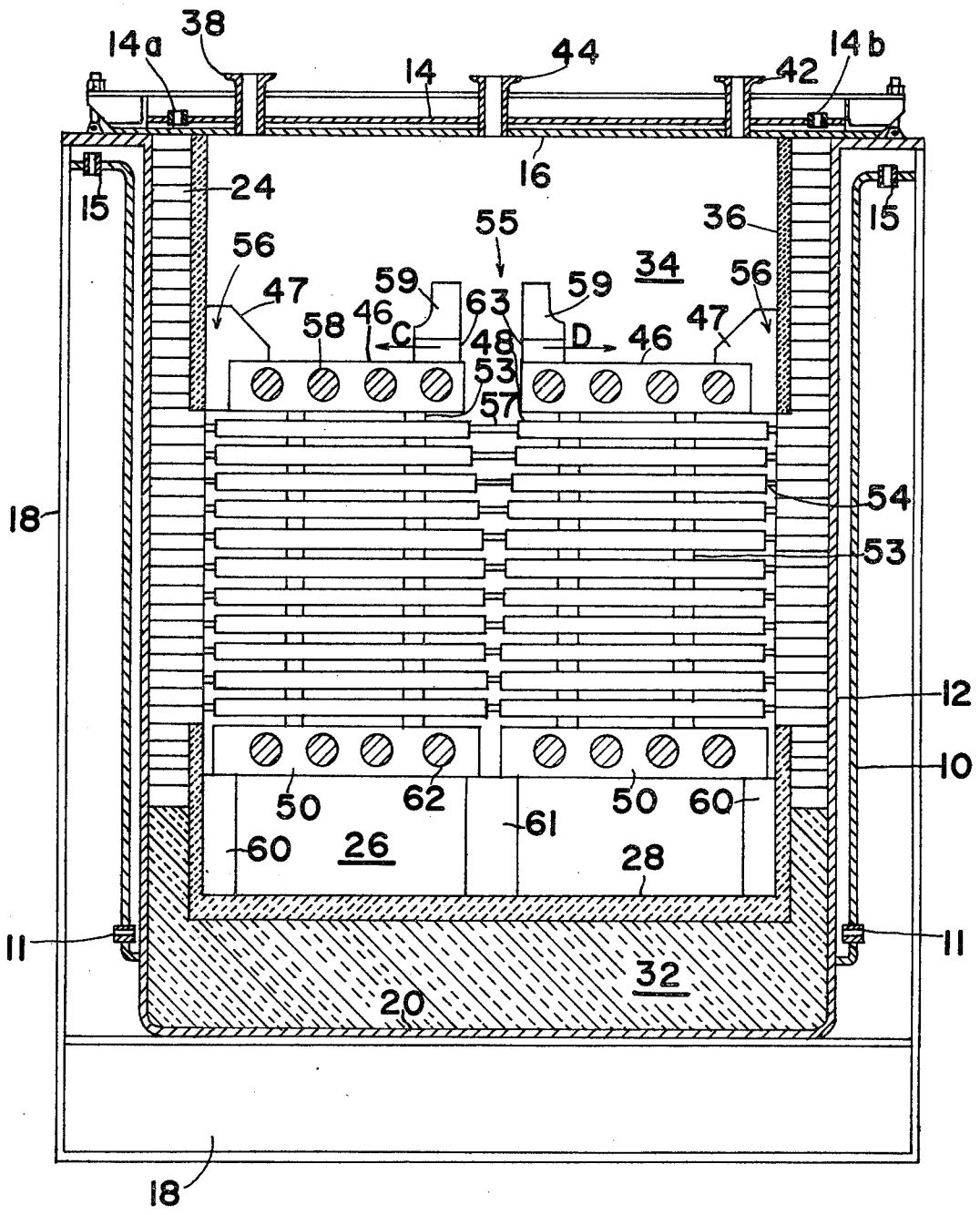
FIG. 1 is a sectional end elevation of a cell for producing metal in accordance with one embodiment of the invention.

A cell for electrolytically producing aluminum by the electrolysis of aluminum chloride dissolved in a molten salt bath utilizing one form of the present invention is illustrated in FIG. 1. The cell structure includes an outer steel cooling jacket 10, which surrounds the steel sides 12 of the cell. A cooling fluid (coolant), for example water, flows through jacket 10 for withdrawing heat from the cell. The coolant enters the cooling jacket at coolant inlet ports 11, and is removed at exit nozzles 15. A similar cooling jacket 14, with representative coolant inlet port **14*a* and coolant outlet port 14*b*, covers the lid 16 of the cell. Lid 16 is exposed directly to chlorine and salt vapors and is made of a suitably chlorine resistant metal such as the alloy nominally containing 80% Ni, 15% Cr, and 5% Fe and sold under the trademark Inconel. All water pipes running to and from the ports of the cooling jackets are provided with rubber hose electrical breaks, so that electrical current cannot move to or from the cell along the otherwise metallic pipes. A structural containment 18, for example of steel, encloses and supports the cell and the cooling jacket. In general, it has been found to be good practice to isolate the cell from the floor, for instance by setting containment 18** on an insulating material such as a thermoset plastic material made from fabric or paper impregnated with phenol-formaldehyde resin, for instance the material supplied under the trademark Micarta by Westinghouse Electric Corp.

The bath containing cell interior surfaces, i.e. those formed by sides 12 and steel bottom 20, are lined with a continuous, corrosion-resistant, electrically insulating lining (not shown) of plastic or rubber material. Good results have been obtained with a lining composed of alternating layers of thermosetting epoxy-based paint and glass fiber cloth. Other plastic or rubber materials are possible.

Inwards of the lining is interposed a glass barrier (not shown). For further information concerning this glass barrier, see the above-mentioned U.S. Pat. Nos. 3,773,643 and 3,779,699.

The cell is also lined with refractory side wall brick 24, made of thermally insulating, electrically nonconductive, e.g. nitride material which is resistant to a molten aluminum chloride-containing halide bath and the decomposition products thereof (see U.S. Pat. No. 3,785,941 issued Jan. 15, 1974, in the name of S. C. Jacobs for "Refractory for Production of Aluminum by Electrolysis of Aluminum Chloride").

An additional lining 36 of graphite is positioned on the side walls alongside and above the anodes 46 to provide further protection against the corrosive influence of the bath and the chlorine gas produced by the operation of the cell. It may be advantageous not to extend this lining 36 right up to lid 16. Rather, ending its upwards reach short of lid 16 can eliminate a danger of short circuiting.

The cell cavity includes a sump 26 in its lower portion for collecting the aluminum metal produced. The sump is bounded by a tub 28 made of graphite. The upper part of tub 28 extends up alongside the cathodes 50. Tub 28 sits on refractory floor 32 including the glass barrier.

The cell cavity also includes a bath reservoir 34 in its upper zone. A first port, tapping port 38, extending through the lid 16 into bath reservoir 34, provides for insertion of a vacuum tapping tube (see British Patent No. 687,758 of H. Grothe, published Feb. 18, 1953.) down into sump 26, through an internal passage to be described with reference to FIG. 2, for removing molten aluminum. A second port, feeding port 42, provides inlet means for feeding aluminum chloride into the bath. A third port, vent port 44, provides outlet means for venting chlorine. These ports are shown open in FIG. 1 just as a matter of convenience. During cell operation, port 38 may have vacuum tapping apparatus associated with it while port 42 will have a feeder mechanism attached to it and port 44 will be connected to a pipeline for carrying-away the chlorine-rich effluent.

Within the cell cavity are a plurality of plate-like electrodes divided up into two stacks. In the direction perpendicular to the plane of FIG. 1, in which direction the depth of the electrodes lies, the electrodes extend such that they abut against the lining of the cell. Each stack includes an upper anode 46, desirably an appreciable number of bipolar electrodes 48 (11 being shown), and a lower cathode 50, all being made, for example, of graphite. These electrodes are arranged in superimposed, spaced relationship defining a series of interelectrode spaces within the cell. Each electrode is preferably horizontally disposed within a vertical stack.

Each cathode 50 is supported by a plurality of graphite lateral support pillars (e.g. pillars 60) and central support pillars (e.g. pillars 61). In the direction of the depth of the electrodes, there are other pillars behind those shown. These hidden pillars are spaced from those shown and from one another, so that bath circulation through sump 26 is possible.

The remaining electrodes are stacked one above the other in a spaced relationship maintained by refractory spacers 53 in the interelectrode spaces, and are connected to, and spaced from, the side walls by individual insulating pins 54. These spacers 53 are dimensioned to closely space the electrodes, as for example to space them with their opposed surfaces separated by less than ¾ inch.

Above the stacks, hold-down blocks 47 bear on the upper surfaces of the anodes 46 to maintain the stacks in place.

In the illustrated embodiment, 12 interelectrode spaces are formed between opposed electrodes in each stack, one interelectrode space between cathode 50 and the lowest of the bipolar electrodes, 10 between successive pairs of intermediate bipolar electrodes, and one between the highest of the bipolar electrodes and anode 46. Each interelectrode space is bounded above by an electrode lower surface (which functions as an anodic surface) and below by an electrode upper surface (which functions as a cathodic surface). The spacing therebetween is referred to as the anode-cathode distance (the electrode-to-electrode distance is the effective anode-cathode distance, due to the sweeping action of the bath, which removes the aluminum as it is formed; this sweeping is the subject of the above-mentioned U.S. Pat. No. 3,822,195). As brought out in U.S. Pat. No. 3,822,195, the anodic surfaces may have chlorine removing channels for getting the chlorine rapidly out of the electrolysis-effective interelectrode spaces.

The molten salt bath has been omitted from the cell for the purpose of better exposing the internal structure of the cell. The bath level in the cell will vary in operation but normally will lie above the anode 46 to fill all otherwise unoccupied space below within the cell.

Inwards of the outer peripheries of the electrodes, i.e. in this embodiment between the separate stacks of electrodes, is located a gas-lift passage 55, maintained by spacers 57. The widths of the electrodes in the stacks are so chosen that the gas-lift passage 55 has its greatest breadth between the anodes 46, the breadth decreasing as one moves down the stacks, with the smallest breadth being between the lowest bipolar electrodes. The gas-lift passage 55 provides for the upward circulation of the bath between the interelectrode spaces inwards of the outer peripheries of the electrodes to the reservoir 34 after passage of the bath through the interelectrode spaces between the electrodes. The flow is induced by the gas-lift effect of the chlorine gas internally produced by electrolysis in the interelectrode spaces.

The above-mentioned chlorine removing channels may be extended right into the passage 55, while being blocked-off on their opposite ends. It has been found that this aids in getting the chlorine started in the right direction, i.e. toward, and into, passage 55. Once the chlorine gets started flowing in the desired direction and provided the various flow cross sections in the cell have been properly dimensioned, the chlorine keeps going in that direction. Thus, the blocking-off of one side of the channels is not indispensible. The gas flow can be gotten started in the desired direction by other means, for example by using a mechanical pumping of the bath or by introducing a pulse of gas at the bottom of passage 55. The dimensioning of passage 55, and the remainder of the flow cross sections in any particular cell, is advantageously carried out using water modeling techniques.

Upcomer dams 59, located adjacent the exit end of the gas lift passage above the anodes, serve to prevent unwanted rechlorination of the electrolyzed metal. The upper portions of the dams protrude above the upper level of the bath and force the lateral flow of the bath above the electrodes to be through passageways 63 in the direction of arrows C and D. Passageways 63 open on both sides of each dam 59 below the surface of the bath, while the bath surface lies below the top of dam 59. The resulting flowpath resists the tendency of pieces of molten metal, which are brought upwards in the passage 55, from breaking the bath surface and getting rechlorinated by the metal-oxidizing chlorine in reservoir 34 above the surface of the bath. It would be best if most of the metal produced on the cathodic surfaces would fall in passage 55 to sump 26, because any metal which is swept upwards can get rechlorinated if it breaks through the upper surface of the bath. This would adversely affect current efficiency. It is to guard against this eventuality that dams 59 are provided. Preferably, the bath flow velocity in the directions of arrows C and D is great enough to perform the sweeping action of U.S. Pat. No. 3,822,195 on the top of anodes 46 in the same manner that the cathodic surfaces in the interelectrode spaces are swept.

Between each electrode stack and the refractory side walls 24, i.e. at the outer peripheries of the electrodes, are two bath supply passages 56 extending past each interelectrode space and past the bipolar electrodes, anode 46 and cathode 50. Each passage 56 is maintained by pins 54, by which there is on each side of the cell a series of aligned gaps between the cell walls and the electrodes, these aligned gaps forming the two passages 56. The movement of bath in the passages 56 is first downwardly past anodes 46, thus passing first into the outside regions of the uppermost interelectrode spaces where portions of the bath split-off to supply and sweep the uppermost interelectrode spaces. Focussing on either of the two sides, the remainder of the bath then flows downwardly past the outside of the next electrode to the outside of the next interelectrode space, and so on. A final portion of the bath may flow on through the openings on the outside of the cathodes 50 into, through the sump 26, then up into passage 55. It will thus be seen that passages 56 make it possible for the bath to circulate downwards peripherally of the electrodes, with the motivating circulatory force being created by the gas-lift action in passage 55 inwards of the outer peripheries of the electrodes.

As brought out above, design of the dimensions of the various parts of the gas-lift and bath supply passages can be carried out advantageously using the principles of water modeling to assure that the forming metal is swept out of each interelectrode space without substantial accumulation of the metal on the cathodic surfaces. For the braoder aspect of the present invention, however, it is not necessary that the bath sweep velocity be high enough to sweep out metal. It need only be sufficient to prevent exhaustion of the dissolved aluminum chloride at the end of the trip of the bath through the particular interelectrode space under consideration.

The anode has a plurality of electrode bars 58 inserted therein which serve as positive current leads, and the cathode has a plurality of collector bars 62 inserted therein which serve as negative current leads. The bars extend through the cell and cooling jacket walls and are suitably insulated therefrom. (See e.g. U.S. Pat. No. 3,745,106 issued July 10, 1973, in the name of S. C. Jacobs for "Fluid Sheathed Electrode Lead for Use in a Corrosive Environment".)

Figure 2:
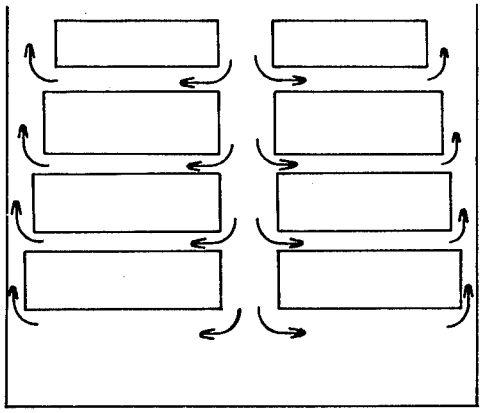
FIG. 2 is a schematic representation of an alternative embodiment of the invention.

FIG. 2 is a schematic diagram of the case opposite to that illustrated in detail in FIG. 1. Here, as shown, by the arrows representing the circulatory flow paths, the bath circulation is downwards inwards of the outer peripheries of the electrodes and upwards peripherally of the electrodes. The blocks arranged in two stacks provide a schematic representation of electrodes such as shown in more detail in FIG. 1. Again the circulatory force is created by gas-lift pumping but this time the pumping is carried out peripherally of the electrodes.

According to the general concept of the present invention, it is not necessary that the circulatory force be created by gas-lifting pumping. For example, a mechanical pump may be used as illustrated in U.S. Pat. No. 2,830,940 issued in the name of R. S. Hood on Apr. 15, 1958 for "Production of Metals".

While the passages in either of the two modes of the invention disclosed herein may be advantageously created by breaking the electrodes into two separate stacks, it is within the broader concept of the invention to provide holes in the electrodes to create the passages.

An advantage common to the two embodiments disclosed herein is that, by providing for some circulation from interelectrode space to interelectrode space inwards of the outer peripheries of the electrodes, bath flow through interelectrode spaces between the electrodes is a shorter trip than would be the case if the bath were circulated between interelectrode spaces only at the electrode peripheries as in U.S. Pat. No. 3,822,195. This is apparent from a consideration of FIG. 1 for instance. If the electrodes in the two stacks were extended inwards to close-up passage 55, with e.g. the right passage 56 then being the gas-lift passage, the bath must sweep twice the distance, before it emerges from any given interelectrode space. A result of the present invention is that the bath sweep velocity in the interelectrode spaces need not be as great as would otherwise be necessary to prevent exhaustion of $AlCl_3$ at the end of any given trip through an interelectrode space. Another result is that evolved chlorine builds up to e.g. only half the volume that it would otherwise at the exit ends of trips of bath through interelectrode spaces.

The two embodiments of circulation disclosed herein for the invention also have their own sets of advantages. In the case where the bath is circulated upwards inwards of the outer peripheries of the electrodes, the bath flow for sweeping the electrode cathodic surfaces free of metal as it is created is inwardly directed toward the centrally located passage. In this case, the sweeping bath collides with oppositely directed sweeping bath in the center of the electrodes, whence the bath rises upwards. This has the advantage that the refractory bricks 24 do not have to stand up against the erosive impact of the sweeping flow of bath and entrained metal.

In the case where the bath flows downwards inwards of the outer peripheries of the electrodes, there is the advantage that the peripherally situated gas-lift passages need only each accommodate one-half of the total upwards gas volume flow as compared with FIG. 1. The danger of large gas bubbles, for instance, flinging the produced molten metal particles upwards into the chlorine in the upper part of bath reservoir 34 is less. There is the additional advantage here that aluminum chloride fed through an off-center port 42 is brought first to the centrally located passageway, so that the interelectrode spaces get a uniform feeding of newly charged aluminum chloride. In the opposite case, the newly charged aluminum chloride tends to move down the right hand passage 56 first, so that the interelectrode spaces in the stack on the right get a better replenishment of aluminum chloride than do their corresponding spaces in the stack on the left.

It will be understood that the above description of the present invention is susceptible to various modifications, changes, and adaptions and the same are intended to be comprehended within the meaning and range of equivalents of the appended claims.

What is claimed is:

1. A method for producing metal by electrolysis in a molten salt bath containing superimposed electrodes, at least one of which is a bipolar electrode, said method including the sweeping of bath through interelectrode spaces between the electrodes, wherein the improvement comprises circulating the bath between interelectrode spaces through a passage at a location inwards of the outer pheripheries of the electrodes, the bath being circulated upwards in said passage and downwards at the outer peripheries of the electrodes.

2. A method as claimed in claim 1 wherein the sweeping is sufficient for sweeping the forming metal off the electrodes.

3. A method as claimed in claim 1 wherein the electrodes are divided into two stacks.

4. A method for producing metal by electrolysis in a molten salt bath containing superimposed electrodes, at least one of which is a bipolar electrode, said method including the sweeping of bath through interelectrode spaces between the electrodes, wherein the improvement comprises circulating the bath between interelectrode spaces through a passage at a location inwards of the outer peripheries of the electrodes, the bath being circulated downwards in said passage and upwards at the outer peripheries of the electrodes.

5. A method as claimed in claim 4 wherein the sweeping is sufficient for sweeping the forming metal off the electrodes.

6. A method as claimed in claim 4 wherein the electrodes are divided into two stacks.

* * * * *

UNITED STATES PATENT AND TRADEMARK OFFICE

CERTIFICATE OF CORRECTION

PATENT NO. : 4,140,594

DATED : February 20, 1979

INVENTOR(S) : Elmer H. Rogers Jr. et al.

It is certified that error appears in the above-identified patent and that said Letters Patent are hereby corrected as shown below:

| | |
|---|---|
| Col. 1, line 14 | After "salt" insert --bath--. |
| Col. 5, line 24 | Change "gas-lifting" to --gas-lift--. |

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*